US011131137B2

(12) United States Patent
Hayman

(10) Patent No.: US 11,131,137 B2
(45) Date of Patent: Sep. 28, 2021

(54) RAPID ACCESS FIREARM SAFE

(71) Applicant: Gary Hayman, Oveido, FL (US)

(72) Inventor: Gary Hayman, Oveido, FL (US)

(73) Assignee: Hayman Safe Company, Inc., Oveido, FL (US)

( * ) Notice: Subject to any disclaimer, the term of this patent is extended or adjusted under 35 U.S.C. 154(b) by 0 days.

(21) Appl. No.: 15/929,551

(22) Filed: May 8, 2020

(65) Prior Publication Data

US 2021/0262276 A1 Aug. 26, 2021

Related U.S. Application Data

(60) Provisional application No. 62/845,219, filed on May 8, 2019.

(51) Int. Cl.

| | |
|---|---|
| ***E05G 1/04*** | (2006.01) |
| ***G07C 9/00*** | (2020.01) |
| ***E05B 65/00*** | (2006.01) |
| ***E05B 47/00*** | (2006.01) |
| ***E05B 49/00*** | (2006.01) |

(52) U.S. Cl.

CPC ..... *E05G 1/04* (2013.01); *E05B 47/0001* (2013.01); *E05B 49/00* (2013.01); *E05B 65/0075* (2013.01); *G07C 9/00563* (2013.01)

(58) Field of Classification Search

CPC ..... E05G 1/04; E05G 1/026; E05G 1/005; E05G 2700/02; G07C 9/00563; E05B 65/0075; E05B 47/0001; E05B 49/00

USPC ..... 206/317; 224/912, 913; 42/70.01, 70.11

See application file for complete search history.

(56) References Cited

U.S. PATENT DOCUMENTS

| | | | | | |
|---|---|---|---|---|---|
| 784,601 | A | * | 3/1905 | Taylor | |
| 3,464,606 | A | * | 9/1969 | Nordeen | B60R 7/14 224/281 |
| 4,532,870 | A | * | 8/1985 | Hayman | E05G 1/00 109/58 |
| 4,788,838 | A | * | 12/1988 | Cislo | F41C 33/06 5/503.1 |
| 5,056,342 | A | * | 10/1991 | Prinz | E05G 1/00 70/63 |
| 5,118,175 | A | * | 6/1992 | Costello | F41C 33/06 206/317 |

(Continued)

OTHER PUBLICATIONS

AMSEC American Security, <https://residential.amsecusa.com/residential-gun-safes/>, Accessed May 5, 2021, Published at least as early as May 5, 2021, 4 Pages.

*Primary Examiner* — Lloyd A Gall

(74) *Attorney, Agent, or Firm* — John J. Bamert, Esq.; Kevin E. Regan, Esq.; Lowe Graham Jones PLLC

(57) ABSTRACT

A rapid access firearm safe having a rigid body with a secure interior storage compartment and a door for accessing a firearm. The door is hingedly attached to the lower portion of the body such that the door swings open from an upper portion of the body, and a firearm retaining mechanism is located on the interior side of the door and releasably holds at least one firearm thereto. A locking mechanism is integrated into the upper portion of the safe body and accessible from the exterior, and the locking mechanism selectively holds the door firmly against the body thereby securely enclosing the interior storage compartment and releases the door from the body upon deactivation by receiving user input.

20 Claims, 3 Drawing Sheets

(56) References Cited

U.S. PATENT DOCUMENTS 5,161,396 A * 11/1992 Loeff ..... E05B 47/0002 109/59 T
5,164,718 A * 11/1992 Cedergren ..... G07C 9/33 340/5.26
5,329,865 A * 7/1994 McWard ..... A47B 46/005 108/93
5,503,088 A * 4/1996 Hayman ..... E05G 1/00 109/50
5,683,021 A * 11/1997 Setina ..... B60R 7/14 206/317
5,701,770 A * 12/1997 Cook ..... E05B 47/02 206/1.5
5,987,941 A * 11/1999 Zocco ..... A47B 81/005 109/59 R
6,405,861 B1 * 6/2002 Siler ..... F41C 33/06 206/1.5
6,843,081 B1 * 1/2005 Painter ..... F41C 33/06 109/45
6,845,640 B2 * 1/2005 Loeff ..... E05B 53/003 109/45
7,047,771 B2 * 5/2006 Tanos ..... E05B 15/0046 211/64
7,159,711 B1 * 1/2007 Gardner ..... F41C 33/06 206/315.11
7,877,920 B2 * 2/2011 Szuminski ..... A47B 96/16 42/70.01
8,104,313 B2 * 1/2012 Wolfe ..... A47B 81/00 70/63
8,752,745 B2 * 6/2014 Bond ..... B62J 9/20 224/413
10,180,303 B2 * 1/2019 Gilbert ..... B65D 43/163
10,253,529 B1 * 4/2019 McGinn ..... E05B 47/0001
10,591,248 B1 * 3/2020 Christiansen ..... E05F 5/06
2004/0144664 A1 * 7/2004 Hammill ..... F41C 33/06 206/317
2006/0065560 A1 * 3/2006 Dickinson ..... F41C 33/06 206/317
2012/0193254 A1 * 8/2012 Kubiniec ..... A47B 96/027 206/317
2015/0101516 A1 * 4/2015 Suggs ..... A47B 81/005 109/64
2016/0095432 A1 * 4/2016 Wirthlin ..... A47B 81/005 312/321.5

* cited by examiner

RAPID ACCESS FIREARM SAFE

CROSS-REFERENCE TO RELATED APPLICATION

This application claims the benefit of U.S. Provisional Application No. 62/845,219, filed May 8, 2019, the entirety of which is hereby incorporated herein by this reference.

BACKGROUND OF THE INVENTION

1. Field of the Invention

The present invention generally relates to safes and reinforced storage cabinets and devices. More particularly, the present invention relates to a safe that provides secure storage of firearms while also allowing rapid access to the firearms secured therewithin.

2. Description of the Related Art

Firearm safes and strongboxes are well known and used to store firearms and ammunition in a secure environment. It is common to also have the firearm safe be fire proof to protect the contents. These safes and strongboxes can have a variety of securing means to access the interior, and such securing means can be slowly accessible such as a combination dial, or quickly accessible, such as a keypad or biometric lock. When rapid access to stored firearms is desired, a fast access lock mechanism is used for the firearm safe or strongbox.

Unfortunately, acts of public violence have been increasing in modern times. Mass shootings at public fora have increased, and even occur at educational institutions. Educational institutions in the United States, such as secondary schools and universities, now have police officers and "resource officers" that work at the institution and who can carry and handle firearms. These officers are in place to handle potential violence, including a shooting attack.

In the instance of a shooting attack, it is desirable for an officer to have access to larger and more powerful firearms, such as shotguns and rifles. It is impractical for the resource officer to carry around large weapons at the educational institution so secure storage of those weapons in a gun safe or vault is normally done. However, if these weapons are needed by the officer, they are needed very quickly and any significant time that is needed to open the safe or vault could be catastrophic.

SUMMARY OF THE INVENTION

In summary, the present invention is a rapid access firearm safe that includes a rigid body, a locking mechanism, and a door that is hinged at the bottom and outwardly opens at the upper portion of the body. The interior of the door has means to hold firearms, which preferably can include at least one long gun such as a shotgun or rifle. The door can open automatically with the lock being deactivated, or can be pulled open once the lock is deactivated. The locking mechanism can be a biometric lock, or accept coded input from a person in order to be activated and/or at least be deactivated.

The safe is particularly advantageous to accommodate long guns and provide rapid access thereto by presenting the stock or pistol grip of the long gun immediately to a person opening the door of the safe. In one embodiment, the person accessing the safe can properly grasp the gun and trigger and use the firearm right after being pulled out of the safe. In other embodiments, the upper part of the long gun, such as the barrel grip/guard is the part of the gun immediately available for a person to grasp.

DETAILED DESCRIPTION

Figure 1:
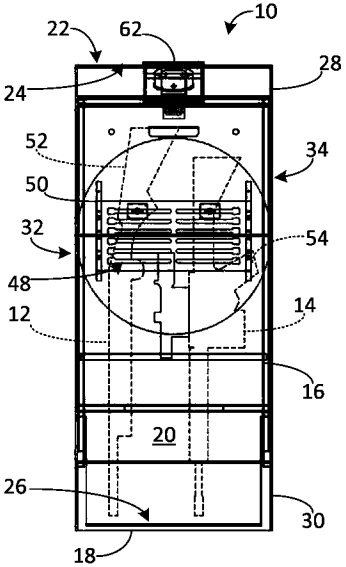
FIG. 1 is a front see-through view of the rapid access gun safe, with the long guns illustrated as being held in position on the door of the safe.

FIG. 1 is a front see-through view of the rapid access firearm safe 10, with the long guns 12,14 illustrated in position on the door 16 of the safe 10. Shown as long guns in outline here is a shotgun 12 and a rifle 14. The rapid access firearm safe 10 has a rigid cubicle body 18 having an interior storage compartment 20 and an exterior surface 22. The body 18 further has a top wall 24 at the upper portion 28 of the body 18, a bottom wall 26 at the lower portion 30 of the body, and at least four side walls 32,34,36,38, as illustrated between FIGS. 1 and 2A.

The rigid body 18 can have any shape, not solely cubicle, but it is preferred that the shape assist in maintaining the structural integrity and rigidity of the safe 10. The rigid material making the body 18 can be metals, such as iron, steel, or alloys, or alternately, rigid polymers or ceramics. It is preferable that the body 18 be at least 36 inches tall (1 meter) to accommodate longer guns on the interior side 40 of the door 16. It should be noted that the door 16 can be flush or slightly recessed from the body 18. The material should be sufficiently strong enough to resist attempts to drill or break into the safe 10. The material can also be inflammable such that the safe 10 can withstand fire and significant temperature to be either fire-resistant or fireproof. Moreover, as is known in the art, the safe 10 can be bolted to or affixed to the ground and/or a wall such that the safe 10 cannot be dislodged or easily moved.

With reference again to FIGS. 1 and 2A, there is a door 16 within a side wall 34 of the body 18, the door 16 having an interior side 40 thereof facing the interior storage compartment 20 and an exterior side 42 (this can the front edge of the body 10 if the door 16 is recessed) thereof. The door 16 is hingedly attached (here, at hinge 44 which is inset in a recess in side wall 38 of the body 10) to the lower portion 30 of the side wall 38 of the body 18 such that the door 16 swings open from the upper portion 28 of the body 18, as is shown through FIGS. 2A to 2C, with the door 16 held firmly against the body 18 in FIG. 2A to being partially open in FIG. 2B to fully open and away from the upper portion 28 of the body 18 in FIG. 2C.

A firearm retaining mechanism 48 is located on the interior side 40 of the door 16 and configured to releasably hold at least one firearm thereto, such as guns 12 and 14 in FIG. 1. Shown here as an example in FIG. 1 is an adjustable clamp system 50 wherein the firearm retaining mechanism 48 is configured to hold at least one long gun releasably and mechanically thereto. The firearm retaining mechanism 48 can be configured to rigidly hold the firearm, such as with the adjustable clamp system 50, or can loosely hold at least one long gun such that the long gun can be substantially vertically extracted therefrom, such as in an open holster affixed to the interior side 40 of the door 16. The direction of vertical extraction of the gun from the open door 16 is shown as Arrow A in FIG. 2C.

The safe is particularly advantageous to accommodate long guns such as long guns 12 and 14 and provide rapid access thereto by presenting the stock (stock 52 of shotgun 12) or pistol grip (grip 54 of assault rifle 14) of the long gun immediately to a person opening the door of the safe. In that embodiment, the person accessing the safe 10 can properly grasp the gun and/or trigger and use the firearm immediately after being pulled out of the safe 10. In other embodiments, such as that shown in FIGS. 2A to 2C, the upper part of the long gun, such as the barrel grip/guard 56 on shotgun 58, is the part of the gun immediately available for a person to grasp. The guns within the safe can have ammunition stored on them, such as ammunition holder 60 on shotgun 58, or the gun can be stored loaded or unloaded.

Figure 2A:
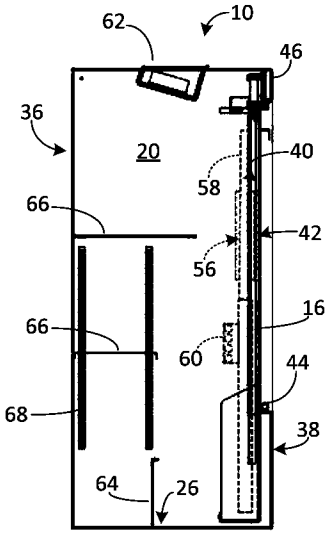
FIG. 2A is a side see-through view of the safe of FIG. 1, illustrating the top view of a shotgun being held on the door.

In the embodiment of FIG. 2A, a locking mechanism 46 is integrated into the upper portion 28 of the body 18 and accessible from the exterior surface 22 of the body 18. The locking mechanism 46 has at least an activation state wherein the locking mechanism 46 selectively holds the door 16 firmly against the body 18 thereby securely enclosing the interior storage compartment 20, i.e. a lock holds the door 16 in place, and a deactivation state wherein the door 16 is releasable from the body 18, i.e. the door 16 can either fall open, be automatically pushed open, or pulled open. In this embodiment, the locking mechanism 46 is configured to receive data for entering at least the deactivation state automatically, and can receive this data from an input pad 62.

The input pad 62 is on the exterior surface 22 of the upper portion 28 of the body 18 and located separately from the locking mechanism 46 in this embodiment. It should be appreciated that the input pad can be placed anywhere on the body 18 of the safe 10. Alternately, the input pad 62 can be physically integrated with the locking mechanism 46 and being in the same physical unit. The input pad 62 is configured to accept user input and is communicatively connected to the locking mechanism 46 in this embodiment to selectively communicate data thereto to cause the locking mechanism 46 to at least enter the deactivation state, i.e. allow the door 16 to be opened. The user input data can be in almost any form of physical interaction by a person with the input pad 62, such as a numeric code, sequence of mechanical actions, a physical key, or an electronic proximity detection such as a specialized ring or bracelet worn by a person. The main attribute to consider for the input data needed to open the safe 10 is speed of the action needed to open the door 16 by an authorized individual. Consequently biometric data or numeric code input are preferable methods of collecting user input.

Thus, in one embodiment, the input pad 62 is a biometric data collector and the user input is biometric data, such as a fingerprint reader, iris scanner, or other biometric data gathering device. In such manner, only a person having the correct biometric data can open the door 16. In an alternate embodiment, the input pad 62 is configured to receive a code input by a user, such as the input of a simple 4 or 6 digit number.

Figure 2C:
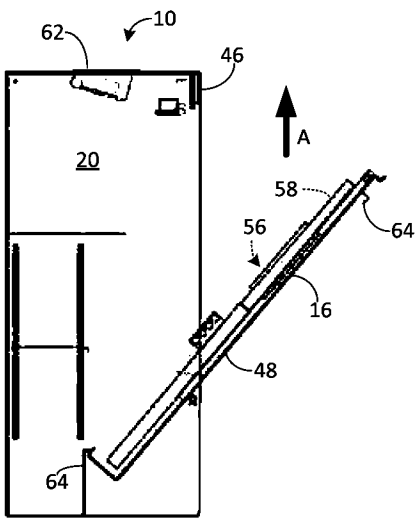
FIG. 2C is a side see-though view of the safe in FIGS. 2A and 2B, with the door fully opened.
Figure 2B:
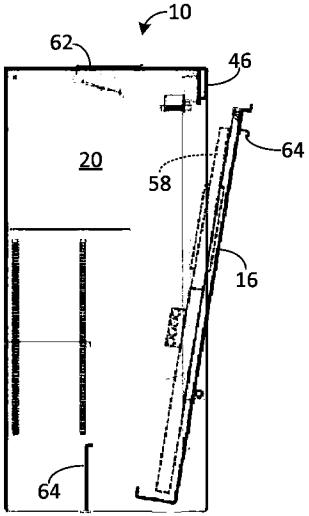
FIG. 2B is a side-see through view of the safe in FIG. 2A, with the door partially opened and a long gun shown in situ on the door.

Given the need to immediately access the firearms, it is preferable that the door 16 automatically opens upon release from the locking mechanism 46. Thus, as shown in FIGS. 2A to 2C, the door 16 will fall open from the upper portion 28 of the body 18. FIG. 2A is a side see-through view of the safe of FIG. 1, which shows an outline of a shot gun 58 as being physically held against the door 16. The input pad 62, here a biometric lock, can be seen on the top wall 22 of the safe. FIG. 2B is a side see-through view of the safe 10, with the door 16 partially opened and the shotgun 58 shown in situ on the door. FIG. 2C is a side see-through view of the safe in FIG. 2B, with the door 16 fully opened.

The safe 10 can automatically be open via a spring or other mechanical motivator on door 16 once the lock mechanism is deactivated, which will aid in the access time to the guns. Alternatively, the door 16 could be manually pulled open by the user upon release of the door 16 from the locking mechanism 46, and the door can have a grip or handle, such as protuberance 64 (FIGS. 2B-C) on its exterior side 42 to allow a user to pull on the door 16 to open it.

As shown in the embodiment of FIGS. 2A to 2C, there is a stop 64 on the bottom wall 26 that stops the door 16 at a predetermined point in its extension from the upper portion 28 from the body 18. The door 16 can be seen as resting against the stop 64 in FIG. 2C with the door 16 fully open.

Also in the embodiment of FIGS. 2A to 2C, the interior storage compartment 20 of the safe 10 can also contain storage space, such as one or more shelves 66. In this embodiment, there are shelf holders 68 on the side walls 32 and 34 that allow shelves 66 to be selectively positioned within the interior storage compartment 20. Thus, other valuable items can be placed within the safe 10, or other firearms, such as pistols, or ammunition can likewise be placed on the shelves and accessible only when the door 16 is open.

Figure 3:
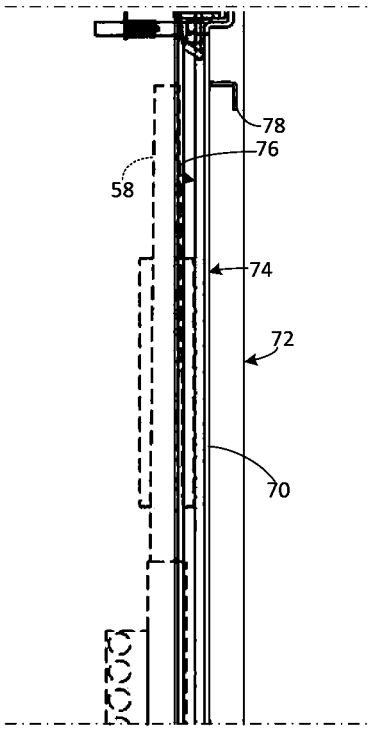
FIG. 3 is a cross-section of the door of the safe in one embodiment with the door recessed from the side wall of the body.

FIG. 3 is a cross-section of the door 70 of the safe in one-embodiment with the door 70 recessed from the side wall 72 of the body 18. Thus, the outer surface 74 of the door 70 is set back from the outer side wall 72 such that the locking mechanism handle 78 is held within the recess. The shotgun 58 is held to the interior side 76 of the door 70 in the same potential manner as described above, such as either with a clamp or holster. It can thus be seen that the door 70 can be embodied as recessed, flush, or resting outside from the side wall 72.

While the invention has been described above in several embodiments, it is to be understood that this description is not intended to limit the spirit and scope of this invention as is particularly set forth in the claims below.

What is claimed is:

1. A rapid access firearm safe, comprising:

a rigid body having an interior storage compartment and an exterior surface, the body further having an upper and lower portion thereof;

a door within the body, the door defining a floor portion and a barrier portion, the barrier portion having an interior side thereof facing the interior storage compartment and an exterior side thereof, the door further hingedly attached to the lower portion of the body such that the door swings open from the upper portion of the body, the floor portion extending into the interior storage compartment from the barrier portion of the door and being configured to move with the barrier portion when the door swings open;

a set of rails disposed on the interior side of the barrier portion of the door;

a firearm retaining mechanism located on the set of rails disposed on the interior side of the barrier portion of the door and configured to releasably hold each stock end portion of at least one shotgun or rifle thereto, wherein the floor portion of the door is disposed below each barrel of each of the at least one shotgun or rifle and is configured to shield a distal opening in each barrel of each of the at least one shotgun or rifle from contents in the interior storage compartment as the door swings open; and a locking mechanism integrated into the upper portion of the body and accessible from the exterior surface of the body, the locking mechanism having at least an activation state wherein the locking mechanism selectively holds the barrier portion of the door firmly against the body thereby securely enclosing the interior storage compartment and a deactivation state wherein the barrier portion of the door is releasable from the body, and the locking mechanism configured to receive user input for entering at least the deactivation state.

2. The safe of claim 1, wherein the locking mechanism is a biometric lock and the user input is biometric data.

3. The safe of claim 1, wherein the locking mechanism is configured to enter the deactivation state by code input by a user.

4. The safe of claim 1, wherein the firearm retaining mechanism is configured to loosely hold the at least one shotgun or rifle such that the at least one shotgun or rifle can be substantially vertically extracted therefrom.

5. The safe of claim 1, wherein the door is spring biased to automatically open upon release by the locking mechanism.

6. The safe of claim 1, wherein the barrier portion of the door is configured to be pulled open upon release by the locking mechanism.

7. The safe of claim 1, further comprising:

an input pad on the exterior surface of the upper portion of the body and located separately from the locking mechanism, the input pad configured to accept user input and is communicatively connected to the locking mechanism to selectively communicate data thereto to cause the locking mechanism to at least enter the deactivation state.

8. The safe of claim 1, wherein the locking mechanism includes an input pad configured to accept user input to at least cause the locking mechanism to at least enter the deactivation state.

9. The safe of claim 1, wherein the locking mechanism is configured to enter the activation state or the deactivation state from user input.

10. The safe of claim 1, wherein the firearm retaining mechanism includes a clamp disposed at an adjustable position on the set of rails.

11. The safe of claim 10, wherein the firearm retaining mechanism holds only each stock end portion of the at least one shotgun or rifle, and no portion of the safe is configured to clamp the barrel of any of the at least one shotgun or rifle.

12. A rapid access firearm safe, comprising:

a rigid cubicle body having an interior storage compartment and an exterior surface, the body further having a top wall, a bottom wall and at least four side walls;

a door within a side wall of the body, the door defining a floor portion and a barrier portion, the barrier portion having an interior side thereof facing the interior storage compartment and an exterior side thereof, the door further hingedly attached to the lower portion of the side wall of the body such that the door swings open from the upper portion of the body, the floor portion extending into the interior storage compartment from the barrier portion of the door and being configured to move with the barrier portion when the door swings open;

a set of rails disposed on the interior side of the barrier portion of the door;

a firearm retaining mechanism located on the set of rails disposed on the interior side of the barrier portion of the door and configured to releasably hold each stock end portion of at least one shotgun or rifle thereto, wherein the floor portion of the door is configured to shield a distal opening in a barrel of each of the at least one shotgun or rifle from contents in the interior storage compartment as the door swings open;

a locking mechanism integrated into the upper portion of the body and accessible from the exterior surface of the body, the locking mechanism having at least an activation state wherein the locking mechanism selectively holds the barrier portion of the door firmly against the body thereby securely enclosing the interior storage compartment and a deactivation state wherein the barrier portion of the door is releasable from the body, and the locking mechanism configured to receive data for entering the activation state and to receive data to enter the deactivation state; and an input pad on the exterior surface of the upper portion of the body and located separately from the locking mechanism, the input pad configured to accept user input and is communicatively connected to the locking mechanism to selectively communicate data thereto to cause the locking mechanism to at least enter the deactivation state.

13. The safe of claim 12, wherein the input pad is a biometric data collector and the user input is biometric data.

14. The safe of claim 12, wherein the input pad is configured to receive a code input by a user.

15. The safe of claim 12, wherein the firearm retaining mechanism is configured to loosely hold the at least one shotgun or rifle such that the at least one shotgun or rifle can be substantially vertically extracted therefrom.

16. The safe of claim 12, wherein the door is spring biased to automatically open upon release by the locking mechanism.

17. The safe of claim 12, wherein the barrier portion of the door is configured to be pulled open upon release by the locking mechanism.

18. A rapid access firearm safe, comprising:

a rigid body having an interior storage compartment and an exterior surface, the body further having an upper and lower portion thereof;

a door within the body, the door defining a floor portion and a barrier portion, the barrier portion having an interior side thereof facing the interior storage compartment and an exterior side thereof, the door further hingedly attached to the lower portion of the body such that the door swings open from the upper portion of the body, the floor portion extending into the interior storage compartment from the barrier portion of the door and being configured to move with the barrier portion when the door swings open;

a set of rails disposed on the interior side of the barrier portion of the door;

a firearm retaining means for releasably holding each stock end portion of at least one shotgun or rifle thereto, the firearm retaining means located on the set of rails disposed on the interior side of the door, wherein the floor portion of the door is configured to shield a distal opening in the barrel of each of the at least one shotgun or rifle from contents in the interior storage compartment as the door swings open; and a locking means for selectively holding the door firmly against the body thereby securely enclosing the interior storage compartment, the locking means integrated into the upper portion of the body and accessible from the exterior surface of the body, the locking means having at least an activation state wherein the locking means selectively holds the barrier portion of the door firmly against the body and a deactivation state wherein the barrier portion of the door is releasable from the body, and the locking means further configured to receive user input for entering at least the deactivation state.

19. The safe of claim 18, further comprising:

an input means for receiving user input, the input means on the exterior surface of the upper portion of the body and located separately from the locking means, the input means configured to accept user input and is communicatively connected to the locking means to selectively communicate data thereto to cause the locking means to at least enter the deactivation state.

20. The safe of claim 18, wherein the locking means further includes an input means for receiving user input to at least cause the locking means to at least enter the deactivation state.

* * * * *